United States Patent [19]

Shanklin et al.

[11] 4,339,093

[45] Jul. 13, 1982

[54] PNEUMATIC ROLL LIFTER

[75] Inventors: Frank G. Shanklin, Groton, Mass.; Francis X. King, Nashua, N.H.

[73] Assignee: Shanklin Corporation, Ayer, Mass.

[21] Appl. No.: 209,395

[22] Filed: Nov. 24, 1980

[51] Int. Cl.[3] ..... B65H 19/30; B65H 17/02; B21C 47/24

[52] U.S. Cl. ..... 242/58.6; 242/68; 242/79

[58] Field of Search ..... 242/68, 58.6, 85, 79, 242/129.62, 129.6, 129.5, 68.4, 86.5 R; 248/127, 130

[56] References Cited

U.S. PATENT DOCUMENTS

| | | | |
|---|---|---|---|
| 3,321,147 | 5/1967 | Martin | 242/58.6 |
| 3,374,964 | 3/1968 | Carvotta | 242/58.6 X |
| 3,830,442 | 8/1974 | Kubovich | 242/68 |
| 4,030,679 | 6/1977 | Pelletier | 242/68 |
| 4,059,243 | 11/1977 | Hartley | 242/129.6 |

*Primary Examiner*—Edward J. McCarthy
*Attorney, Agent, or Firm*—Charles E. Pfund

[57] ABSTRACT

Apparatus for loading rolls of sheet material wound on cores into automatic wrapping machines wherein spindles are employed to support the rolls on overhead bearings for unwinding comprising a support upon which one end of the roll of sheet material to be loaded onto the bearings can be lifted and slid thereonto below the bearings, a hinge support mounting one of the bearings so that it can be moved from its operative position in alignment with the other bearing to an out-of-the-way position, and whereupon the ends of the roll spindle are centered over the bearings and the lift is retracted to lower the roll onto the aligned bearings.

25 Claims, 6 Drawing Figures

PNEUMATIC ROLL LIFTER

BACKGROUND OF INVENTION

High speed automatic wrapping machines of the horizontal form-fill-seal variety have been used for many years. Most of these machines utilize forming heads and have a roll of flat film mounted above the product conveying and wrapping section of the machine. The roll of flat film is mounted so that the axis of the core upon which the film is wound is transverse to the axis of the machine and the film is fed from the roll over a series of rolls having various functions such as guidance, power film driving, etc. and down over forming heads which form the film around the product. On some of these machines which have been designed primarily for shrink packaging the product size capability of the machine is quite large. For instance, many of the machines will wrap a product up to 16 inches wide by 4 inches high and will accept film rolls 40 inches long. These rolls are very heavy and can weigh over 80 pounds and because the forming head is large, the rolls are mounted quite high above the machine.

The standard procedure for loading a full roll of film onto a machine is to use two people, one at either side of the machine, so that they can together lift the film roll up to the height required to load it into the bearings which support it for unwinding. The lift is generally to above shoulder height and when installing a large roll, it takes two men to do the job. The alternative system for loading film is to install a small overhead crane to pick up the roll and spindle and load it into place. There are three difficulties with the overhead crane. The first is that in some buildings it is difficult to install an overhead crane; the second is that an overhead crane can be expensive; the third occurs when customers move their machines from place to place. If a machine is moved, of course, it would be necessary to move the overhead crane. This is relatively impractical.

Because it is so difficult to load film into place in such high speed automatic wrappers, some of them are equipped with dual roll unwinds. The dual roll unwind permits the film to be loaded in advance when the personnel are available to do the job and and then when the first roll runs out, the second roll is fed into the system. The dual roll unwinding adds size and complexity to the film handling system of the machine.

The object of this invention is to provide a unique system for loading rolls of film into a high speed automatic wrapper whereby a single operator can load a roll of film without the aid of an overhead crane and without the complexity of dual roll unwinding.

SUMMARY OF INVENTION

As herein illustrated, the apparatus is for loading a roll of film wound on a core into an automatic wrapping machine wherein there are aligned bearings for rotatably receiving the ends of the spindle upon which the core is mounted for unwinding of the roll, said apparatus comprising means supporting the bearings with one bearing stationary and the other movable to an out-of-alignment position, lifting means situated below the line of centers of the bearings for engaging the ends of the spindle of a roll supported below the bearings for lifting the roll to a position in which the axis of the spindle is above the level of the bearings, said movable bearing being movable to bring it into alignment with the stationary bearing beneath the spindle when the latter has been lifted to said level above the bearings, whereupon the roll is shifted axially to center the ends of the roll with respect to the bearings and the lifting means is retracted to lower the spindle onto said bearings. There is means for adjusting the roll axially to position the roll so that it will track correctly when the machine is running comprising spaced collars at the end of the spindle adjacent the movable bearing and means on the movable bearing support movable into a position to be engaged between said collars when the roll is lowered into engagement with the bearings. The support for supporting the movable bearing is movable about a horizontal axis situated below the line of centers of the bearings and at right angles thereto, and there is means for locking and releasing the movable support so as to enable moving the movable bearing to an out-of-the-way position preparatory to mounting the spindle on the bearings and locking it in position after the spindle has been mounted onto the bearings. The roll support for supporting the roll below the line of centers of the bearings comprise spaced, parallel rods or rollers parallel to the line of centers of the bearings so positioned relative to each other that a line parallel to and midway between the axis of the bars is situated vertically below the line of centers of the bearings. The lift means comprise means defining upwardly open recesses dimensioned to receive the ends of the spindle and means for elevating and lowering the lift means, the latter, optionally, comprising air cylinders. There is at one end of the rods means for loading a roll onto the rods comprising means defining an arcuate bearing surface positioned with its axis of curvature at right angles to and above the rods and spaced guides associated with the bearing surface for preventing lateral movement of the roll relative to the rods as the roll is pushed axially across said surface onto the rods. Specifically, the aforesaid loading means comprise a cylinder supported on a horizontal shaft at right angles to the bars having conical end portions.

The invention will now be described with reference to the accompanying drawings, wherein.

Figure 1:
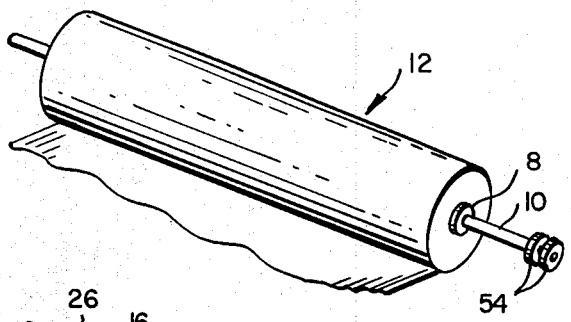
FIG. 1 is a perspective of a roll of sheet material wound on a spindle.

The sheet material used in wrapping in automatic wrapping machines is wound on cores 8 as shown in FIG. 1. The rolls 12 constituted by the sheet material wound on the cores are placed on spindles 10 for loading onto bearings in the automatic wrapping machine for unwinding over suitable guides. Some of these rolls of sheet material on the larger automatic winders are so heavy that it requires two persons to lift the roll into the bearings. It is the purpose of this invention to enable a single operator to mount a roll on the bearings of an automatic wrapping machine and this is achieved as will now be described by modifying the bearing structure at one side of the automatic wrapper and providing mechanical means for assisting the operator to mount the roll into the machine below the bearings and pneumatic means for thereafter lifting the roll onto the bearings.

Figure 2:
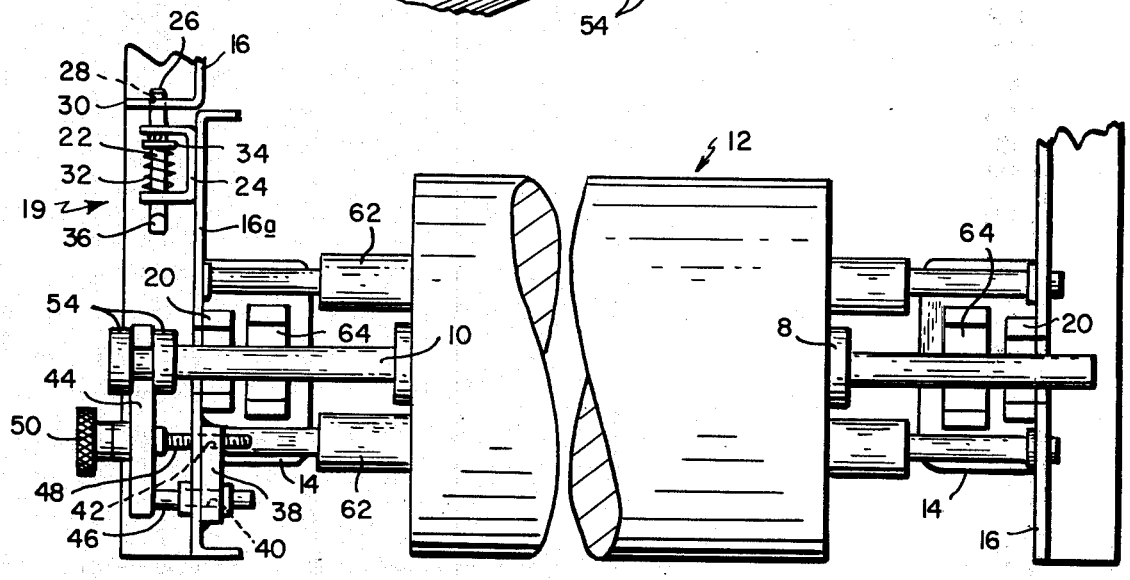
FIG. 2 is a top view of a portion of an automatic wrapping machine showing a roll of sheet material mounted thereon for unwinding.
Figure 3:
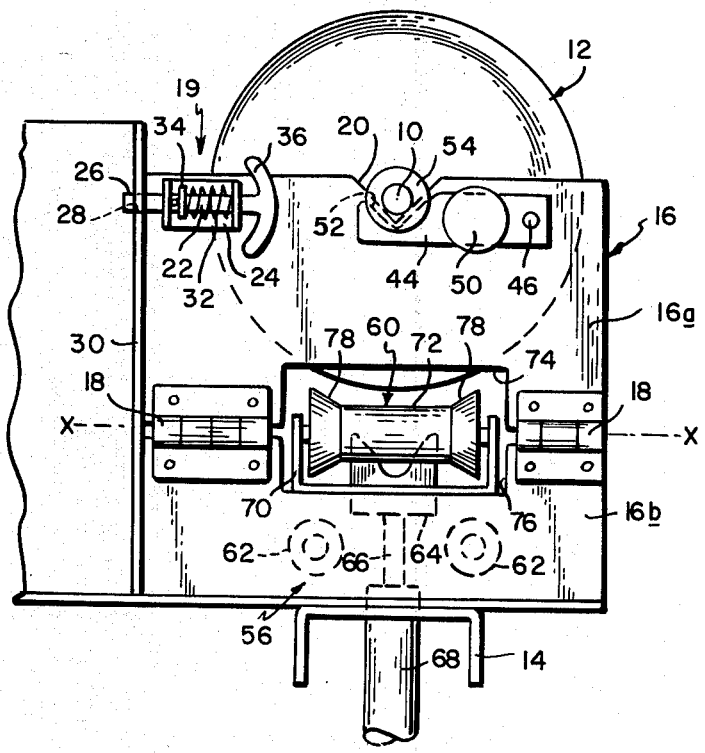
FIG. 3 is an elevation as seen from the left-hand side of FIG. 2.

Referring specifically to FIGS. 2 and 3, there are shown spaced, parallel frame members 14—14 of a high speed automatic wrapper to which are attached spaced, parallel, upstanding side wall members 16—16. These side wall members 16—16 support in their upper edges oil impregnated hardwood blocks having upwardly-open, V-shaped notches 20—20 which constitute bearings for rotatively receiving the ends of the spindle 10. The wood block bearings provide a minimum drag on the shaft 10 to brake the roll unwind sufficiently to eliminate the need for a band brake or other braking device. The wall member 16 at the right-hand side as viewed from FIG. 2 is rigid from top to bottom. In contrast, the wall member 16 at the left-hand side is hinged between its upper and lower ends as shown in FIG. 3 so that the upper part **16*a* can be folded outwardly and downwardly with respect to the lower part 16*b* about a horizontal axis represented by the axis X—X of the hinge means 18—18** shown in FIGS. 3, 4, 5 and 6.

The upper side wall part **16*a* is normally held in an upright position parallel to the opposite wall member 16 by latch means 19, FIGS. 2 and 3, comprising a pin 22 supported in a bracket member 24 with one end 26 engaged within an opening 28 provided in a flange 30 comprising a part of the side wall member 16 at that side by means of a coil spring 32 bearing at one end upon the bracket member 24 and at its other end upon a collar 34. A handle 36 provides for withdrawing the end 25 of the rod from the hole 28 to allow the upper wall part 16*a*** to be folded downwardly.

There is also mounted to the upper side wall part **16*a* at the inner side thereof a block 38 containing a smooth bore hole 40 and a threaded hole 42. A plate 44 is mounted on the outer side of the upper wall part 16*a* by means of a spindle 46 fixed to the plate 44 which slidably extends through the smooth bore hole 40 and a screw 48 which is rotatably mounted in the plate 44 and is threaded into the threaded hole 42. The outer end of the screw 48 is provided with a knurled head 50. As thus constructed, by rotating the screw 48, the plate 44 can be moved toward and away from the upper side wall part 16*a*. The plate 44 is provided with an upwardly-open notch 52 for rotatably receiving the end of the spindle 10 resting in the bearings 20—20 and there is provided on the spindle spaced, parallel collars 54—54 adapted to be engaged with the opposite sides of the plate 44 so that when the latter is moved toward and from the upper wall portion 16*a*, the spindle 10 can be shifted axially in its bearings 20—20** in order to track film over the head properly while the machine is running.

Figure 4:
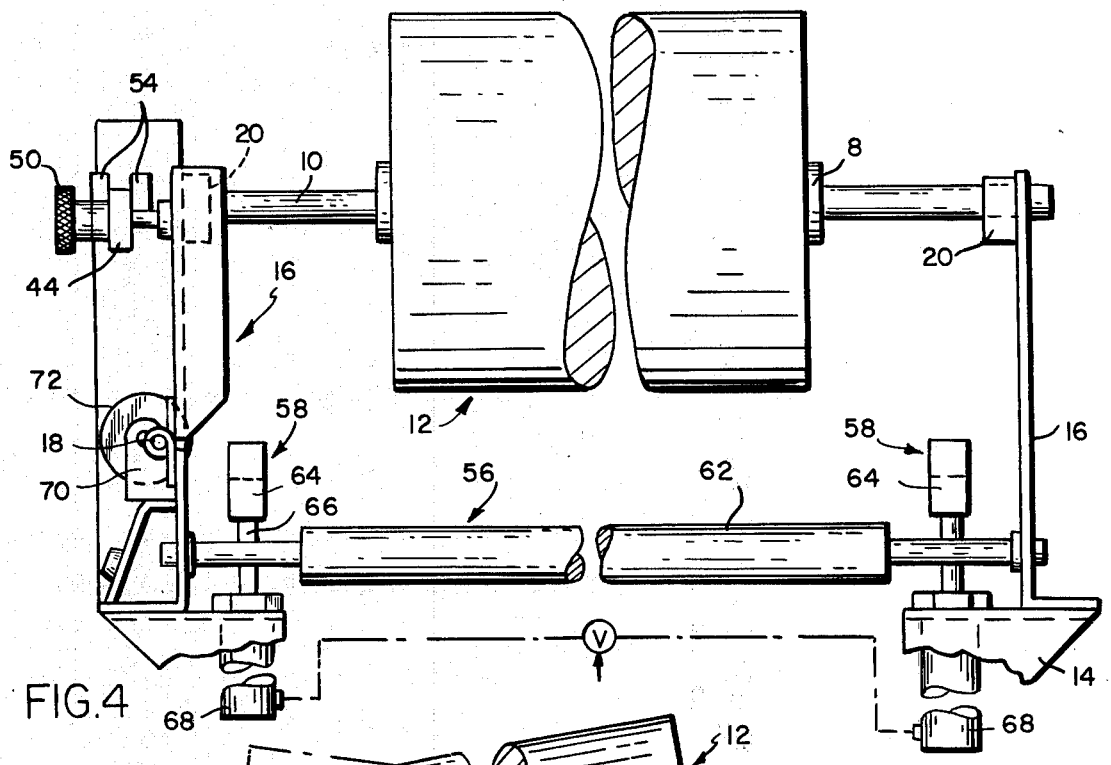
FIG. 4 is a front elevation.

As has been previously stated, the bearings 20—20 are located quite high from the ground and in order to lift the roll to this height to set it onto the bearings 20—20, there is provided roll supporting means 56, FIGS. 3 and 4, between the side wall members 16—16 for supporting the roll in a position beneath the bearings 20—20 with the axis of the spindle parallel to the center line of the bearings 20—20, power lift means 58 for lifting the roll from the supporting means 56 up to the bearings and a manual assist 60 to enable the operator to mount the roll onto the roll supporting means 56.

The roll supporting means 56 comprises spaced, parallel elongate members in the form of rods 62—62 supported in a horizontal position with their opposite ends set into the side members 16—16 and so arranged with respect to the center line of the bearings 20—20 that a line midway between their axes is situated vertically below the line of centers of the bearins 20—20.

Figure 5:
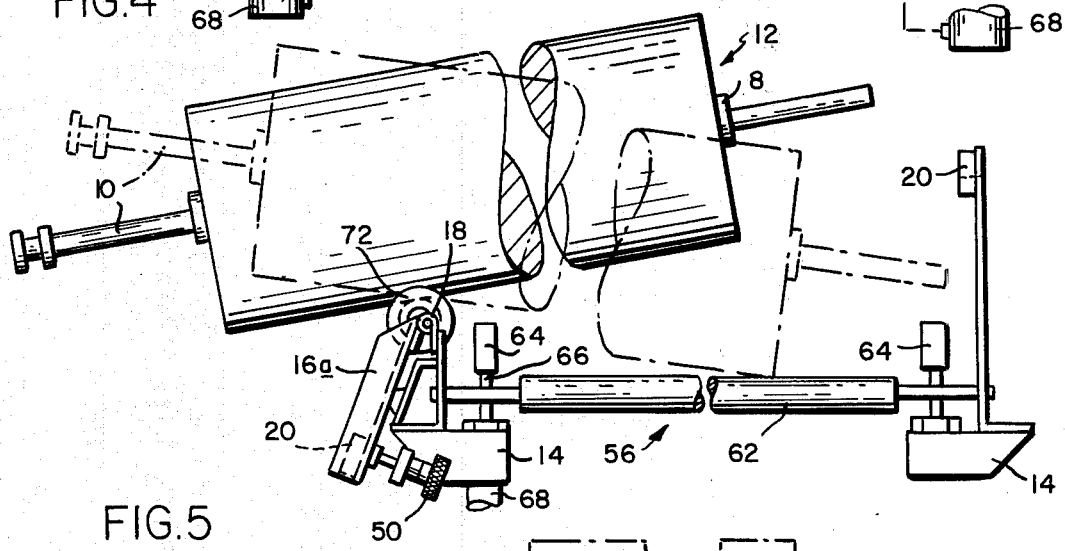
FIG. 5 is a fragmentary front elevation showing an initial step in the loading operation.
Figure 6:
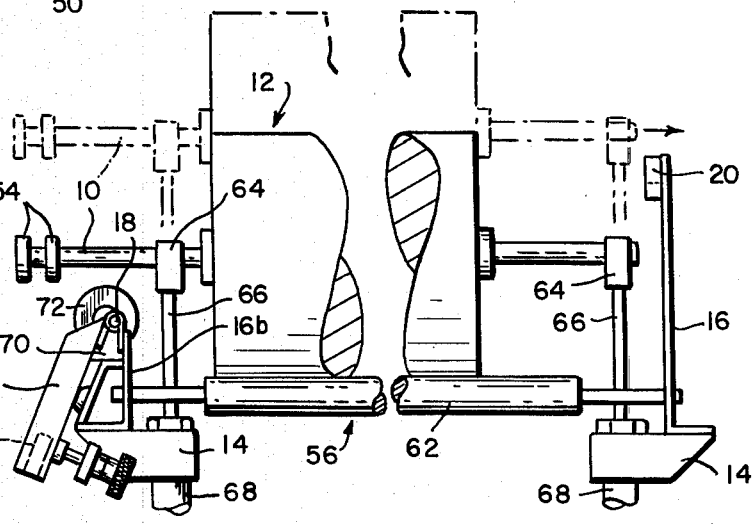
FIG. 6 is an elevation showing the final step of the loading operation.

The power lift means 58 comprise two forks 64—64 fixed to the upper ends of rods 66—66 which extend vertically upward from air cylinders 68—68 and are so located that they are positioned midway between the rods 62—62 so as to be aligned with the axis of the spindle of a roll resting on the rods 62—62 and to be normally situated below the spindle of a roll resting on the rods 62—62. The forks 64—64 are made of a low friction material, for example, but without limitation, high density polyethylene. As thus constructed, when a roll is placed on the support rods 62—62 and air is supplied to the cylinders 68—68, the forks 64—64 are raised to a level above the bearings 20—20. Since the right-hand bearing 20 is stationary, it is necessary when mounting the roll on the rods 62—62 to displace the roll away from the fixed bearing sufficiently so that when it is raised upwardly, the end of the bearing can clear the stationary bearing 20 at the right side. After the roll has been elevated so that the spindle is above the bearings 20—20, the upper part **16*a* of the side wall 16 which was heretofore folded downwardly as shown in FIGS. 5 and 6 is folded upwardly and latched in place. The roll and spindle assembly is then moved axially in the low friction forks 64—64 until the collars 54—54 are aligned so that plate 44 is directly beneath and between the collars, whereupon the lifts are withdrawn to allow the spindle to seat on the bearings 20—20**.

The manual assist 60 for assisting the operator in mounting a roll on supporting rods 62—62 comprises a horizontally mounted cylinder 72 supported at its ends in a bracket 70 secured to the frame of the machine for rotation about a horizontal axis substantially parallel to the hinge line x—x. As shown in FIG. 3, the upper and lower wall parts **16*a*,16*b* are provided, respectively, with openings 74 and 76 for accommodating the cylinder 72 and the opposite ends of the latter are provided with conical portions or shaft collars 78—78. As thus positioned and located with respect to the hinge between the upper and lower parts 16*a*,16*b*, the upper surface of the cylinder 72 is above the hinge line x—x and is also above the rods 62—62, but is appreciably closer to the floor than the spindle bearings 20**.

To load a roll, the operator lifts the roll off the ground, holding one end at approximately hip height and the other end at about chest height. The upper portion of the roll is placed onto the upper surface of cylinder 72 and is confined between the conical portions 78—78. It is then pushed longitudinally so that it rolls up into the position shown by solid lines in FIG. 5. After its center of gravity passes over cylinder 72, the roll is lowered onto supporting rods 62 so that it is in a position shown by phantom lines in FIG. 5. The roll is then pushed into the machine until the right hand side of the spindle is aligned over the fork 64 of the lifting cylinder, and is adjacent to the right hand spindle bearing 20. At this point, the roll of film is fully deposited on rods 62—62, as shown in FIG. 6. This manual assist enables a single operator to easily load a very heavy roll onto the roll support. Thereafter, as previously explained, the pneumatic lift is employed to lift the roll up to a position above the bearings, whereupon the downwardly-folded side wall part **16*a* is folded upwardly to dispose the bearings so carried thereby beneath the spindle and latched into place. The roll 12 is then moved axially to align the collars 54—54 on opposite sides of the plate 44. The lifts 58 are retracted lowering the roll until the spindle 10 is supported by bearings 20—20. Final axial alignment can then be made by turning knurled knob 50**.

To unload an empty spindle or a partially used roll the steps which have been described are essentially reversed.

The loading apparatus as thus described, while designed for loading rolls of film onto an automatic wrapper, can be used in conjunction with any apparatus where it is necessary to load a heavy roll of material wound on a core onto bearings which are at such a height as would make it difficult or dangerous for an operator to try to load the roll.

The roll supporting 56 means while shown in the form of parallel rods 62—62 can just as well be rollers and the fork lifts 58—58 could be actuated by hydraulic pressure or by a mechanically-actuated, ratchet-type mechanism. Furthermore, the cylinder 72 could be replaced by a fixed bar having a smooth, polished surface to reduce friction beneath it and the surface of the roll being pushed across it.

It should be understood that the present disclosure is for the purpose of illustration only and includes all modifications or improvements which fall within the scope of the appended claims.

What is claimed is:

1. Apparatus for loading a roll of sheet material wound on a core onto supporting bearings for unwinding comprising a spindle, aligned bearings for rotatably receiving the ends of the spindle, means supporting the bearings with one bearing stationary and the other movable to an out-of-alignment position, and lifting means situated below the line of centers of the bearings for engaging the ends of the spindle of a roll supported below the bearings in a position of axial displacement with respect to the stationary bearings for lifting the roll to a position in which the axis of the spindle is above the level of the line of centers of the bearings, said movable bearing being thereafter movable to bring it into alignment with the stationary bearing beneath the spindle when the latter has been lifted to said level above the line of centers of the bearings and said lifting means being operable to lower the ends of the spindle onto said aligned bearings.

2. Apparatus according to claim 1 wherein the support for supporting the movable bearing is movable about a horizontal axis situated below the line of centers of the bearings and at right angles thereto.

3. Apparatus according to claim 1 wherein there is means for locking and releasing the movable support so as to enable moving the movable bearing to an out-of-the-way position preparatory to mounting the spindle on the bearings and locking it in position after the spindle has been mounted on the bearings.

4. Apparatus according to claim 1 wherein the bearings are upwardly open V-shaped recesses.

5. Apparatus according to claim 1 comprising means for supporting the roll below the line of centers of the bearings in spaced, parallel relation thereto in a position such that the lower side of the spindle is above the lifting means.

6. Apparatus according to claim 1 wherein there is means for supporting the roll below the bearings comprising transversely-extending, spaced, parallel elongate members, parallel to the line of centers of the bearings so positioned relative to each other that a line parallel to and midway between the axes of said elongate members is situated vertically below the line of centers of the bearings.

7. Apparatus according to claim 1 wherein the lifting means comprise means defining upwardly open recesses dimensioned to receive the ends of the spindle and means for elevating and lowering said lifting means.

8. Apparatus according to claim 7 wherein the lifting means are comprised of low friction material.

9. Apparatus according to claim 7 wherein the lifting means are forks comprised of high density polyethylene.

10. Apparatus according to claim 7 wherein the means for elevating and lowering the lifting means are air cylinders.

11. Apparatus according to claim 10 wherein there is means for supplying air simultaneously to both air cylinders for lifting and lowering in unison.

12. Apparatus according to claim 5 comprising means for loading the roll onto the means for supporting the roll comprising at one end of the means for supporting the roll means defining a curved surface positioned with its axis of curvature at right angles to the means for supporting the roll and above the means for supporting the roll.

13. Apparatus according to claim 12 wherein said curved surface is positioned symmetrically with respect to the means for supporting the roll.

14. Apparatus according to claim 12 wherein there are spaced guides associated with said curved surface for preventing lateral movement of the roll relative to the means for supporting the roll as the roll is pushed across said curved surface onto the means for supporting the roll.

15. Apparatus according to claim 12 wherein the means for loading the roll comprises a cylinder rotatable on a horizontal axis at right angles to the means for supporting the roll.

16. Apparatus according to claim 15 wherein the cylinder has conical collars at its end.

17. Apparatus according to claim 1 wherein there is means for adjusting the axial position of the roll relative to the bearings after the roll has been lowered to engage the ends of the spindle with the bearings.

18. Apparatus according to claim 17 wherein the aforesaid means comprises spaced collars on the end of the spindle adjacent the movable bearing and means adjustably mounted on the bearing support positioned thereon in a position to be engaged by the spaced collars when the roll is lowered to engage the ends of the spindle with the bearings for axial adjustment of the roll while the machine is running.

19. Apparatus for loading a roll of film into a high speed automatic wrapping machine wherein there are spaced, aligned bearings and the roll of film is wound on a core supported on a spindle, the ends of which are adapted to be seated in the bearings for supporting the roll for unwinding comprising means supporting one of the bearings for movement relative to the other to an out-of-alignment position, means defining a stationary roll support situated below the line of centers of the bearings for supporting the roll with its axis parallel to the line of centers of the bearings, means defining lifts at opposite ends of the support movable into engagement with the ends of the spindle when the roll is resting on the roll support for lifting the roll from the roll support to an elevated level above the level of the bearings, said means for supporting the movable bearing being operable to allow movement of the movable bearing to a position below the spindle at said elevated level and said lift means being operable to lower the roll to engage the ends of the spindle with the bearings.

20. In an apparatus for paying out sheet material from a roll of sheet material wound on a core supported on a spindle, transversely-spaced, aligned, upwardly-open bearings for rotatably receiving the ends of the spindle, means supporting one of the bearings stationary, means supporting the other bearing for movement out of alignment with the one bearing, means defining a roll support situated between the bearings for supporting a roll with its spindle parallel to the line of centers of the bearings with the roll displaced axially from the stationary bearing, lift means engageable with the ends of the spindle at the position of rest of the roll on the roll support operable to lift the roll to a position such that the ends of the spindle are above the bearings, said means supporting the movable bearing being movable to move the movable bearing into a position of alignment with the stationary bearing beneath the spindle, said spindle lifting means comprising a low friction material to permit said spindle to be shifted axially into proper alignment on said bearings, said lifting means being operable after shifting to lower the roll to engage the ends of the spindle with the aligned bearings.

21. Apparatus according to claim 20 wherein the means for supporting the bearings comprise a stationary part supporting the stationary bearing and a hinged part supporting the movable bearing and said hinged part is foldable about a horizontal axis situated below the line of centers of the bearings and at right angles thereto to on the one hand move the movable bearing out of alignment with the stationary bearing and on the other hand to move it into a position of alignment with the stationary bearing.

22. In an automatic wrapping machine, a supporting structure comprising spaced, parallel supports, transversely-aligned bearings on said spaced, parallel supports for rotatably receiving the ends of a spindle upon which is mounted a core wound sheet of material for unwinding of the sheet material preparatory to a wrapping operation, a first support mounted between the spaced, parallel supports below the bearings and parallel to the line of centers of the bearings for supporting a roll of sheet material below the bearings preparatory to being lifted onto the bearings, a pair of transversely-supported lifts mounted on the structure adjacent the opposite ends of the first support for engagement with the ends of the spindle of a roll resting on the first support to lift the roll from the first support onto the bearings, hinge means supporting one of the bearings for movement away from the other about a horizontal axis at right angles to the transverse axis of the first support and above the first support to enable moving the one bearing to an out-of-the-way position below the axis of the hinge, a second support having a surface parallel to the hinge and at approximately hinge level for receiving one end of a roll lifted to an inclined position for supporting the one end while the other end is lifted, and means associated with said second support for guiding the roll while sliding it axially across said second support onto the first support.

23. The method of loading a roll of film wound on a core onto a machine wherein a spindle is employed to support the roll on bearings for unwinding comprising mounting one of the bearings so that it can be moved out of alignment with the other which is stationary, moving the movable bearing out of alignment with the stationary bearing, positioning the roll below the bearings with the axis of the spindle substantially parallel to the line of centers of the bearings and displaced axially so that the end adjacent the stationary bearing is displaced with respect to said stationary bearing, with the aid of a power lift engaging the ends of the spindle and lifting the roll upwardly to a level above the stationary bearing, moving the movable bearing back into alignment with the stationary bearing, shifting the roll axially to center it with respect to the bearings and lowering the roll to seat the ends of the spindle in said bearings.

24. The method according to claim 23 comprising providing a roll support below the bearings and loading the roll onto said roll support.

25. The method according to claim 24 comprising providing a loading support at one end of the roll having a surface positioned transversely with respect to the roll support and above the roll support, lifting the roll to a position in which one end is resting on the loading support and then pushing the roll axially across the loading support onto the roll support.

* * * * *